United States Patent [19]

Couture

[11] 4,336,948

[45] Jun. 29, 1982

[54] SKATE BLADE

[76] Inventor: George Couture, 1301, rue De-Laune, Quebec City, Quebec, Canada

[21] Appl. No.: 115,231

[22] Filed: Jan. 25, 1980

[30] Foreign Application Priority Data

Jul. 13, 1979 [CA] Canada ..... 331741

[51] Int. Cl.[3] ..... A63C 1/32

[52] U.S. Cl. ..... 280/11.12; 264/273; 280/11.18

[58] Field of Search ..... 280/11.18, 11.17, 11.12, 280/11.1 R; 264/273, 274, 230, DIG. 71, 237; 249/88, 91; 29/434, 530

[56] References Cited

U.S. PATENT DOCUMENTS

| | | | |
|---|---|---|---|
| 476,650 | 5/1892 | Wierda | 280/11.18 |
| 1,115,790 | 11/1914 | Drevitson | 280/11.17 |
| 1,459,050 | 6/1923 | Drevitson | 280/11.12 |
| 3,558,149 | 1/1971 | Weidenbacker | 280/11.12 |
| 3,954,278 | 5/1976 | McLeod | 280/11.12 |
| 3,967,832 | 7/1976 | Chambers | 280/11.12 |
| 4,053,168 | 10/1977 | Goverde | 280/11.12 |
| 4,071,938 | 2/1978 | Chambers | 280/11.12 |
| 4,074,909 | 2/1978 | Baikie | 280/11.18 |
| 4,085,944 | 4/1978 | Chambers | 280/11.12 |
| 4,088,335 | 5/1978 | Norton et al. | 280/11.18 |
| 4,093,249 | 6/1978 | Chambers | 280/11.12 |
| 4,131,288 | 12/1978 | Wilson | 280/11.12 |
| 4,132,424 | 2/1979 | Olivieri | 280/11.12 |
| 4,223,900 | 9/1980 | Olivieri | 280/11.12 |

FOREIGN PATENT DOCUMENTS

| | | | |
|---|---|---|---|
| 585720 | 10/1959 | Canada | 280/11.18 |
| 586441 | 11/1959 | Canada | 280/11.17 |
| 634068 | 1/1962 | Canada | 280/11.17 |
| 697856 | 11/1964 | Canada | 280/11.12 |
| 984422 | 2/1976 | Canada | 280/11.12 |
| 985322 | 3/1976 | Canada | 280/11.12 |
| 981714 | 1/1976 | Canada | 280/11.18 |
| 989436 | 5/1976 | Canada | 280/11.12 |
| 1026781 | 2/1978 | Canada | 280/11.12 |

*Primary Examiner*—David M. Mitchell

*Attorney, Agent, or Firm*—Burns, Doane, Swecker & Mathis

[57] ABSTRACT

An ice skate runner for use in a skate holder has an elongated metal body with a solid central portion and a pair of elongated cut-outs, one on either side of the central portion extending towards the end of the runner. The portion of the cut-out adjacent the central portion is wide and the cut-out tapers downwardly in width towards the end of the runner. The plastic holder for the runner is molded around the latter so that the plastic flows through the cut-outs. The solid central portion of the runner locks the plastic at that area and forces the plastic on cooling to shrink from both ends of the runner towards the center, relieving stress in the combination. Spacer pins are inserted in the mold adjacent the ends of the runners during the molding process and then removed thereafter to allow shrinkage space between the ends of the holder and the ends of the runner.

4 Claims, 6 Drawing Figures

26
22
16
14
20
30
28
24
18

SKATE BLADE

BACKGROUND OF INVENTION

Conventionally, ice skate blades used for ice hockey have been constructed entirely of steel. In order to obtain the necessary strength and ruggedness these skate blades had fairly thick runners, approximately 0.180 inches. Subsequently, the tube and hollow column construction, known as the tube skate, was developed to reduce weight without reducing the strength or ruggedness of the runner and to allow construction of a thinner runner, approximately 0.120 inches, to increase speed. Improved quality steels and metallurgical processes, welding methods, etc. have made it possible for skate blade manufacturers to continue to improve the all-steel blades over the last few decades.

Subsequently, an attempt was made to further reduce the weight of the hockey skate blade by using a combination of plastic and steel instead of an all-steel construction. Canadian Pat. No. 585,720 was an early example of such construction. However, due to excessive runner breakages, the product was discontinued.

Eventually, a composite assembly, a plastic-steel skate, was introduced and these are now fairly common in the art, several manufacturers marketing a product using a plastic bridge component and a steel runner.

The conventional plastic-steel skate arrangements have achieved the objective of reducing the weight of the assembly as compared to an all-steel hockey skate but the resistance to breakage of the skate runner has been found to be far inferior in conventional plastic-steel skate assemblies when compared to the all-steel skate blades still in use and accordingly the use of the composite blades in present construction presents a hazard to the user and others on the ice surface.

Some examples of conventionally practiced methods of construction in composite skate arrangements are to be found in the following Patents: U.S. Pat. No. 4,131,288 issued Dec. 26, 1978 to Wilson, U.S. Pat. No. 4,071,938 issued Feb. 7, 1978 to Chambers, U.S. Pat. No. 4,074,909 issued Feb. 21, 1978 to Baikie, U.S. Pat. No. 4,093,249 issued June 6, 1978 to Chambers, U.S. Pat. No. 4,088,335 issued May 9, 1978 to Norton et al, U.S. Pat. No. 4,085,944 issued Apr. 25, 1978 to Chambers, U.S. Pat. No. 3,967,832 issued July 6, 1976 to Chambers, U.S. Pat. No. 3,954,278 issued May 4, 1976 to McLeod, U.S. Pat. No. 4,053,168 issued Oct. 11, 1977 to Goverde, Canadian Pat. No. 984,422 issued Feb. 24, 1976 to Baikie, Canadian Pat. No. 985,322 issued Mar. 9, 1976 to Tvengsberg, Canadian Pat. No. 989,436 issued May 18, 1976 to Baikie, Canadian Pat. No. 697,856 issued Nov. 17, 1964 to Fiorjancic et al, Canadian Pat. No. 585,720 issued Oct. 27, 1959 to Kirkpatrick et al.

The above examples of the prior art show various methods of connecting a steel runner to a plastic holder, the holder subsequently being secured to a skate boot. These methods include rivets as shown in the Wilson U.S. Pat. No. 4,131,288 with a portion of the runner being extended up into the columns of the holder. In the Chambers U.S. Pat. No. 4,071,938 the runner shown in FIG. 2 is provided with a plurality of circular apertures through which rivets 45 are subsequently provided to attach the runner to the lower part of the holder. Vertical bolts are used in the U.S. Pat. to Baikie, No. 4,074,909 to detachaby secure the blade to the columns of the holder as shown in FIG. 3 of that Patent.

Of the plastic steel skates now in use none meets the impact or compression tests sustained by the all-steel hockey skate blade. Tests show that they are all substantially inferior in ruggedness. This accounts for the exceedingly high breakage rate. It will be appreciated that when a skate runner breaks and is ejected from the plastic bridge, it assumes the character of a lethal weapon and is a menace to ice hockey players and in some cases to spectators.

In order to reduce the excessive breakage of steel runners, the manufacturers of current plastic blades have reduced the Rockwell hardness of the runners to as low as 50° R.C., the maximum hardness found being 55° R.C. Conversely, the runners of all steel hockey skates are hardened to 58°-60° R.C. As the resistance to wear and therefore the retention of sharpness is directly related to the hardness of the runner it is desirable to have as hard a runner as possible. However, with a hard, brittle runner in the presently manufactured plastic holders, the runner shatters easily due to the lack of holder support. Lowering the hardness of the runners cuts down on the breakage but results in an inferior runner.

SUMMARY OF INVENTION

It is a feature of the present invention to provide an ice hockey skate blade which will be considerably lighter than the all-steel blade but which will possess the ruggedness and resistance to breakage equivalent to or superior to that of the all-steel hockey blade whereby the product will be far less hazardous and much safer than the plastic-steel skate blades now in use. Another feature of the present invention is to provide a runner of greater strength than those used in all-steel tube skates because in the latter form, the runner holder, which is a hardened tube, gives greater resistance to impact and compression loads to the runner than is the case when the runner holder is made of plastic or of any other material which is not as strong as steel.

Another feature of the present invention is to provide a runner which is held in a plastic bridge in such a way as to avoid stresses in the plastic bridge due to shrinkage in the molding process.

A further feature of the present invention is to provide a skate runner held in a plastic bridge in such a manner as to prevent ejection and the flying out of any part of the runner if the runner should break because of excessive abuse, etc.

According to a broad aspect, the invention relates to an ice-skate runner for use in a molded plastic skate-holder. The skate-runner comprises an elongated, planar metal body having a lower, ice-engaging edge extending end-to-end along one side thereof and an upper edge which also extends end-to-end for being secured in the plastic skate-holder which is molded around it. The metal body of the skate-runner has a wide, central web portion intermediate the ends of the body and extending between the upper and lower edges of the runner. At least one cut-out is provided in the metal body on either side of the central web for receiving plastic material of the holder therein. Each cut-out provides an opening which is completely surrounded by the metal body and is elongated with the end adjacent the central web being wider than the other end.

According to another broad aspect, the invention relates to a combined ice skate runner and plastic holder therefor, the holder comprising a heel column and a sole column, each column including a plate on the upper end thereof for connecting the holder to a skate boot. A bridge member interconnects the columns, the runner having a lower portion including a hardened ice-engaging edge and an upper portion, hardened to a lesser degree, embedded in the plastic holder. The upper portion of the runner has a wide central web and at least one elongated opening on either side thereof. Each of the openings taper downwardly in width from the central web towards the end of the runner whereby the material of the plastic holder flows through openings and shrinks toward the central web of the runner.

A still further broad aspect of the present invention relates to a method of manufacturing a combined ice skate runner and holder, the runner having a wide central web and an elongated cut-out on either side thereof and tapering downwardly in width from the central web towards the ends of the runner. The method comprises the steps of placing the runner in a mold cavity; inserting spacing pins of a predetermined width at the ends of the runner on the outside thereof; injecting a plastic material into the cavity to form the runner holder, the material flowing through said cut-outs and around the outside of the pins and around the top edge of the runner; and withdrawing said pins to allow said plastic to cool whereby the ends of the holder will shrink towards the central web into the spaces provided by said pins and into the wide areas of the cut-outs, and everywhere around the runner without building up significant stresses in said combination.

In the molding process the plastic is forced to shrink on cooling towards the central web whereby the ends of the holder will shrink towards the central web and will close the space provided by the pins. In shrinking in this manner, the plastic in the cut-outs and the plastic molded around the runner will flow towards the central web without building up significant stresses in the holder.

BRIEF DESCRIPTION OF THE DRAWINGS

The invention is illustrated by way of example in the accompanying drawings in which.

DETAILED DESCRIPTION OF A PREFERRED EMBODIMENT

Figure 2:
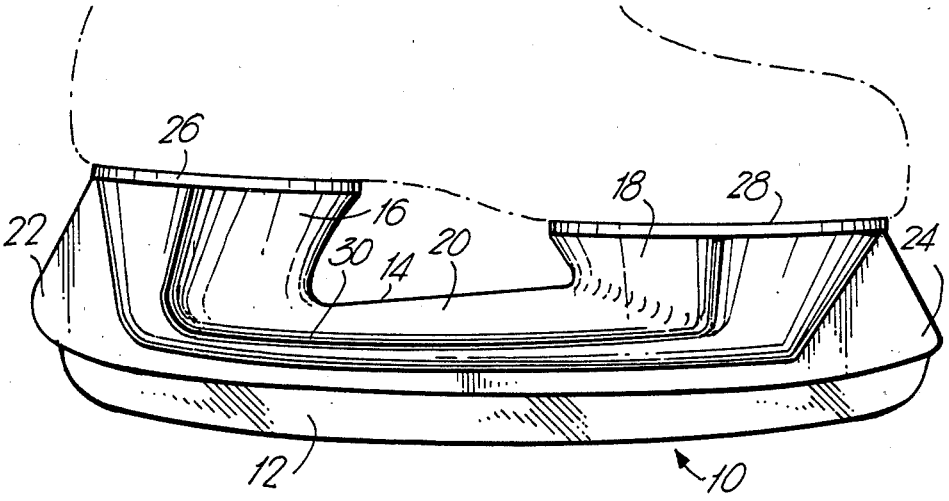
FIG. 2 is an elevation view of the combination plastic holder and steel runner.
Figure 3:
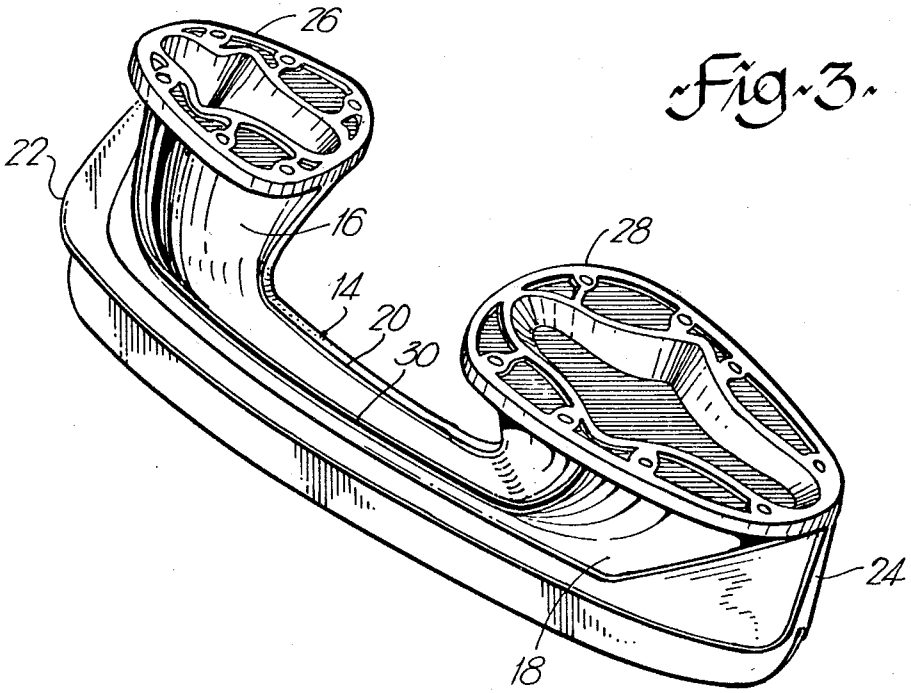
FIG. 3 is a perspective view of the device in FIG. 2, and FIGS. 4, 5 and 6 illustrate steps in the method of manufacturing the combined holder and blade of FIG. 2.

Referring firstly to FIGS. 2 and 3, a combined plastic-metal ice skate blade indicated generally at 10 includes a steel skate runner 12 secured in a holder 14 of plastic material. The holder includes a heel column 16 and a sole column 18 as well as a bridge portion 20 interconnecting the two columns, the holder including a heel safety guard 22 and a toe guard 24. The upper ends of the heel and sole columns 16 and 18 are provided respectively with plates 26 and 28 for securing the columns and therefor the holder and runner to the sole of the skate boot. As seen clearly in FIGS. 2 and 3 the bridge 20 is provided with reinforcing rib 30 extending from the plate members along the columns and bridge portion of the plastic holder.

Figure 1:
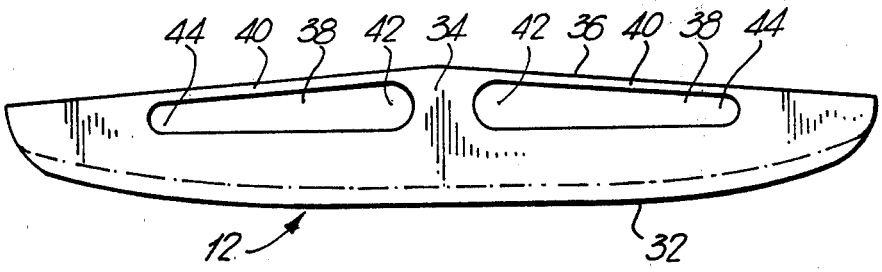
FIG. 1 is a plan view of the skate runner according to the invention.

Turning to FIG. 1, the runner 12 includes an ice-engaging lower edge 32, that portion of the runner adjacent the lower edge inwardly to approximately the dash and peck line (about $\frac{3}{8}$ of an inch) being hardened to approximately 60° R.C.

The runner of the present invention is designed with certain features to avoid undue stresses which occur in the holder and the runner in the molding process. To this end, the runner 12 has a fairly wide, solid, central portion 34 from which point the general configuration is narrowly tapered from the central portion towards each end of the runner.

On either side of the central portion 34 there is provided an elongated cut-out 38, the provision of which reduces the weight of the runner. The remaining steel strip 40 in the top section of the runner 12 retains the necessary ruggedness required in the runner.

Each cut-out 38 has an inner wide end 42 tapering narrowly downwardly to narrow ends 44 as illustrated. As shown in the drawings, it is desirable that the top edge of the cut-outs 38 run generally parallel to the top edge of the runner 12, the remaining steel strip 40 therebetween should not be appreciably thicker near the inner end 42 of the cut-out than it is near the outer end 44 of the cut-out. The shape of the cut-outs 38 and the unobstructed lines of the upper surface 36 of the runner 12 allows plastic material of the holder to shrink towards the center web 34 without building up stress in the plastic as will be explained in relation to FIGS. 4–6. Additionally, it will be appreciated that the provision of these openings and the central web 34 serves to retain the runner in the bridge even if the runner becomes broken.

Figure 4:
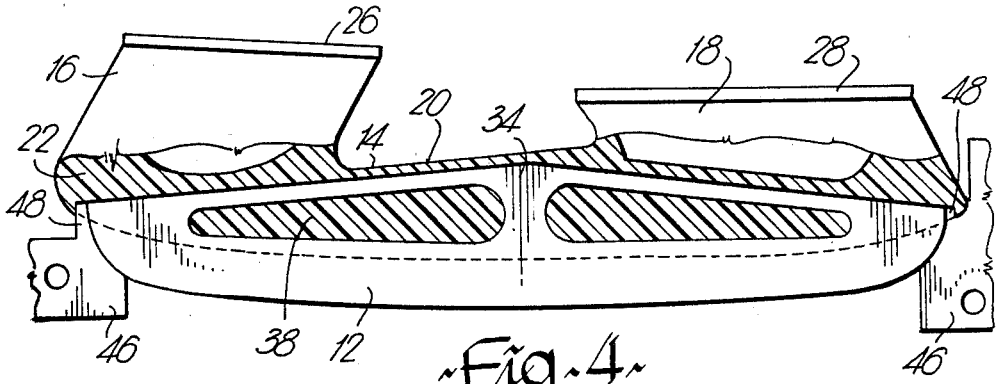
Figure 5:
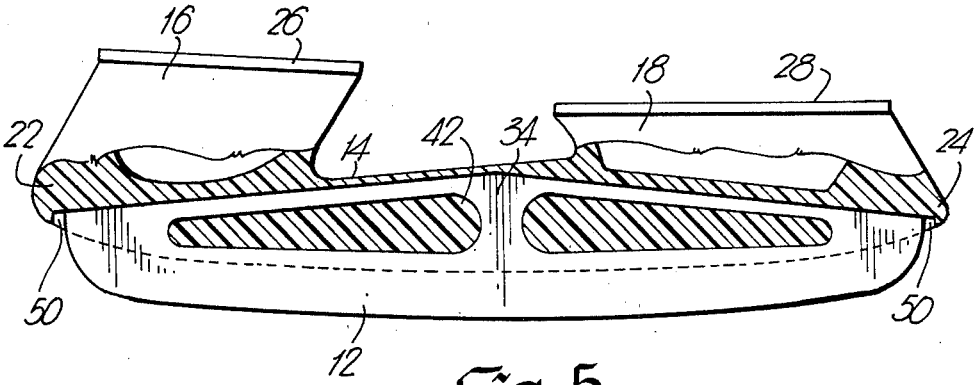
Figure 6:
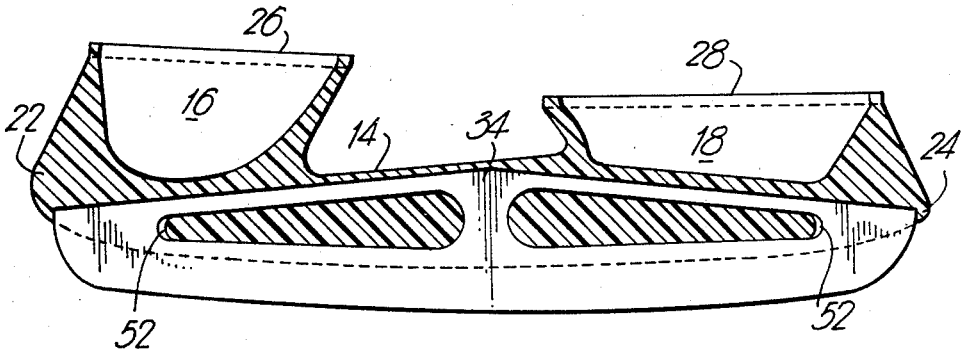

Referring to FIGS. 4, 5 and 6, the runner 12 is placed in a suitable mold, not shown, so that the plastic material of the holder 14 can be molded around the runner.

It is important to have both ends of the runner covered with the plastic in the form of the toe guard 24 and heel guard 22 so that the ends of the runner are not exposed. This is accomplished by providing in the mold as shown in FIG. 4, pins or plates 46 having projections 48, these projections being of a predetermined size so that after the holder material has been molded around the runner 12 as in FIG. 4, the projections 48 will leave spaces 50 as shown in FIG. 5, these spaces providing for shrinkage of the plastic towards the runner when the ice skate is removed from the mold (FIG. 5) so that the plastic fills these two spaces without the creation of stress in the plastic at these two points as shown in FIG. 6.

It will be appreciated that in the molding process the plastic contracts or shrinks more than does the steel runner and provision is made to avoid the building of stress in the plastic by means of the spaces 50 and by means of the solid central portion of the runner which locks the plastic at that area and forces the plastic on shrinking to shrink towards the center and when completely cooled as in FIG. 6, may leave small shrinkage gaps 52 as illustrated. The runner design having a wider section at 34 than at both ends allows the cut-outs 38 to be wider at the inner ends 42 than at the outer ends 44 and yet not reduce the width of the steel sections of the bottom of the runner near area 42 below the width of the section near area 44 as shown for example in FIG. 1.

In summary, the runner of the present invention meets the rigid tests which can be sustained by all-steel blade runners and are therefore far superior to the runners currently found in the prior art.

A series of tests were carried out on runners of the present invention in which the runner was mounted vertically upside-down on steel supports at both ends and a 50 lb. weight was dropped onto the runner from various heights in order to obtain various impact loads. The part of the weight which strikes the runner consists of a two-inch diameter steel pipe to impart forces to the ice skate runner similar in nature to those encountered in ice hockey, when for example a player falls and crashes into a goal post. Runners were also subjected to static loads when mounted in a similar fashion.

Runners of the prior art break when subjected to 1,000 lb. loads. A runner according to the present invention takes on a permanent bend when subjected to 2,500 lbs. and did not break when subjected to 4,500 lbs.

The prior art runners broke when subjected to an impact of 50 lbs. falling seven inches and the runner of the present invention did not break when subjected to an impact of 50 lbs. falling twenty-nine inches.

Such tests are more severe when the runner is bare than when carried out on runners attached to the holder as the latter, whether all-steel or plastic, acts as a cushion and takes some of the load off of the runner.

A runner according to the present invention hardened throughout to 55° R.C., that is to the maximum hardness of the prior art runners, breaks with a static load of 1,600 lbs. whereas the prior art runners break at 1,000 lbs. This serves to illustrate that the design shape of the present invention gives a stronger blade than the prior art.

I claim:

1. A combined ice skate runner and plastic holder therefor, said holder comprising a heel column and a sole column, each column including a plate on the upper end thereof for connecting the holder to a skate boot, and a bridge member interconnecting said columns; said runner comprising a planar, elongated metal body having a lower portion including a hardened, ice-engaging edge and an upper portion embedded in the plastic holder, said runner having a wide central web intermediate the upper and lower edges and at least one elongated opening on either side of said web; each said opening being completely surrounded by portions of said metal body, said opening tapering downwardly in width from the central web towards the ends of the runner such that, during construction, the material of the plastic holder flows through said openings and shrinks toward the central web of the runner.

2. The combined runner and holder of claim 1, wherein the top edge of each of said at least one opening is substantially parallel to said upper edge.

3. The combined runner and holder of claim 1 wherein said central web is solid and said metal body is tapered such that said central web is wider than both ends of said metal body.

4. The method of manufacturing a combined ice skate runner and holder, said runner having a wide central web and an elongated cut-out on either side thereof and tapering downwardly in width from the central web towards the end of the runner; comprising the steps of:

placing the runner in a mold cavity;

inserting spacing pins of a predetermined width at the outside ends of the runner;

injecting a plastic material into said cavity to form the runner holder said material flowing through said cut-outs and around the outside of the pins and around the top edge of the runner; and withdrawing said pins to allow said plastic to cool whereby the ends of the holder will shrink towards the central web into the spaces provided by said pins and into the wide areas of the cut-outs, and everywhere around the runner without building up significant stresses in said combination.

* * * * *